US007673368B2

(12) United States Patent
Cloud, III

(10) Patent No.: US 7,673,368 B2
(45) Date of Patent: Mar. 9, 2010

(54) DUST BAG ARRANGEMENT AND FILLING INDICATOR FOR FLOOR CARE APPARATUS

(75) Inventor: John A. Cloud, III, Nicholasville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 1131 days.

(21) Appl. No.: 11/252,950

(22) Filed: Oct. 18, 2005

(65) Prior Publication Data

US 2007/0084011 A1 Apr. 19, 2007

(51) Int. Cl.
*A47L 9/00* (2006.01)
*A47L 7/00* (2006.01)
*B08B 5/00* (2006.01)

(52) U.S. Cl. ..... 15/339

(58) Field of Classification Search ..... 15/339
See application file for complete search history.

(56) References Cited

U.S. PATENT DOCUMENTS 2,192,224 A * 3/1940 Forsberg ..... 96/421
3,381,652 A 5/1968 Schaefer et al.
3,678,882 A 7/1972 Kinsella
4,124,916 A * 11/1978 Fromknecht ..... 15/339
4,199,838 A * 4/1980 Simonsson ..... 15/339
4,330,900 A 5/1982 Dorr et al.
4,416,033 A 11/1983 Specht
4,419,782 A 12/1983 Sobczyk et al.
4,443,235 A * 4/1984 Brenholt et al. ..... 96/408
4,481,692 A 11/1984 Kurz
4,654,924 A * 4/1987 Getz et al. ..... 15/319
4,733,431 A 3/1988 Martin
5,033,151 A 7/1991 Kraft et al.
5,081,738 A 1/1992 Schiller et al.
5,155,885 A * 10/1992 Jyouraku et al. ..... 15/319
5,163,202 A 11/1992 Kawakami et al.
5,233,682 A 8/1993 Abe et al.
5,251,358 A 10/1993 Moro et al.
5,276,939 A 1/1994 Uenishi
5,542,146 A 8/1996 Hoekstra et al.
5,946,770 A * 9/1999 Bijma et al. ..... 15/339
6,026,539 A 2/2000 Mouw et al.
6,029,309 A 2/2000 Imamura
6,085,382 A * 7/2000 Bobrosky et al. ..... 15/350
6,237,648 B1 * 5/2001 Busacca et al. ..... 141/95
6,571,422 B1 6/2003 Gordon et al.
6,836,930 B2 1/2005 Thur et al.
6,901,624 B2 6/2005 Mori et al.

* cited by examiner

*Primary Examiner*—Bryan R Muller
(74) *Attorney, Agent, or Firm*—King & Schickli, PLLC

(57) ABSTRACT

A floor care apparatus has a housing, including a wall, for storing a dust bag. The dust bag is angled relative to the wall and pressure sensors fill the space between the wall and dust bag. During use, as dust fills the bag, the bag expands and impinges upon a first of the pressure sensors and subsequently upon a second of the pressure sensors thereby indicating a filling of the bag with dust. A processor, connected to each of the pressure sensors, sorts a relative difference between signals of the sensors during dust filling. A visual indicator displays to users the relative fullness of the dust bag. To achieve angular disposition between the wall and dust bag, tapers, angular walls, ribs or combinations thereof are contemplated.

16 Claims, 11 Drawing Sheets

DUST BAG ARRANGEMENT AND FILLING INDICATOR FOR FLOOR CARE APPARATUS

TECHNICAL FIELD

The present invention relates generally to the floor care field. More particularly, it relates to a floor care apparatus, such as a canister or upright vacuum cleaner, having a dust bag filling indicator and arrangement therefor.

BACKGROUND OF THE INVENTION

Whether canister or upright, vacuum cleaners in all of their designs and permutations have become increasingly popular over the years. In general, vacuum cleaners incorporate a suction fan motor, attendant dirt cup or dust bag and a nozzle assembly fluidly and mechanically connected to one another that suck up dirt and dust during operator movement across a dirt-laden floor. Specifically, an agitator within the nozzle assembly rotates to beat the nap of a carpet and dislodge dirt and dust during a time when an operator manipulates the cleaner back and forth. Dirt and dust then enter the cleaner and flow in an airstream toward the motor. Somewhere upstream of the motor, the dust and air are separated and particles are trapped in the dirt cup or dust bag.

While dirt cups allow users to visually inspect whether the cup is full and requires dumping, users of cleaners with dust bags have little, if any, indication external to the cleaner of when the dust bag becomes full and needs replacement. While some cleaners have incorporated bag full indicators, many require sophisticated algorithms, including fuzzy logic, complex mechanical arrangements, including pistons, springs or other, and/or audible alarms. In this regard, sophistication and complexity adds costs while audible alarms can annoy users.

Accordingly, the floor care arts have need of simple, yet effective, bag fill indicators and arrangements therefor.

SUMMARY OF THE INVENTION

In accordance with the purposes of the present invention as described herein, an improved floor care apparatus is provided. The apparatus may take the form of a canister or an upright vacuum cleaner or may embody an extraction cleaning device or other hereinafter developed product having a dust bag requiring a bag-full indicator.

In one embodiment, the floor care apparatus has a housing with an internal chamber for holding a dust bag during use. The housing, including a wall, carries the bag in an angular disposition relative to the wall. In a space between the wall and bag, a plurality of pressure sensors are positioned. During use, as dust fills the bag, the bag expands and impinges upon a first of the pressure sensors and then upon a second of the pressure sensors, and so on, thereby indicating a filling of the bag with dust. A processor, connected to each of the pressure sensors, sorts a relative difference between the signals supplied by the sensors during dust filling. A visual indicator displays to users the relative fullness of the dust bag.

In other embodiments, the visual indicator includes a segmented display or gauge. Tapered dust bags, angular housing walls, ribs or combinations thereof are also contemplated. Preferred angular orientations between the bag and wall range from about 15 to about 45 degrees.

In the following description there is shown and described possible embodiments of the invention, simply by way of illustration of one of the modes best suited to carry out the invention. As it will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serves to explain the principles of the invention. In the drawings.

DETAILED DESCRIPTION OF THE INVENTION

Figure 1:
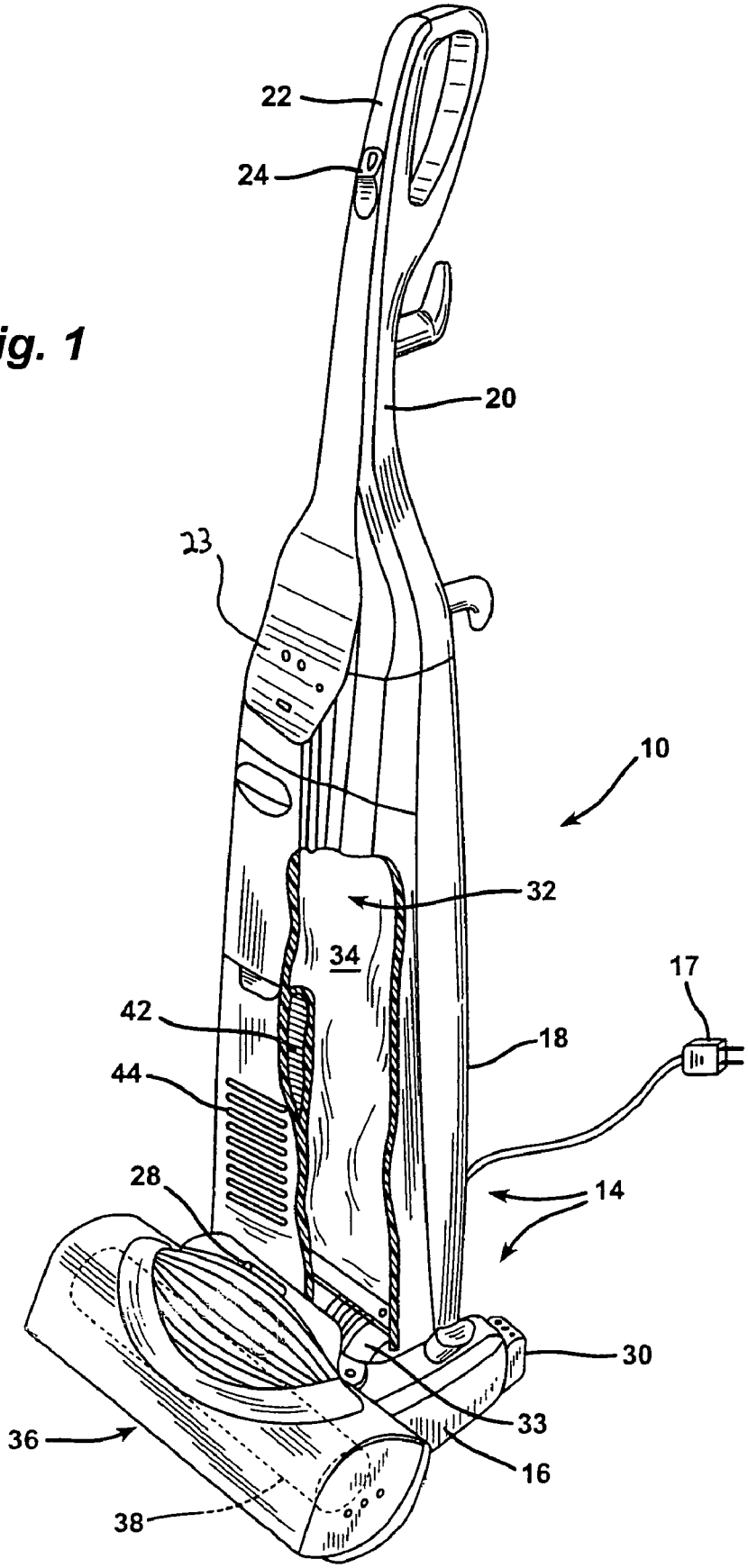
FIG. 1 is a perspective view of a floor care apparatus, in this instance an upright vacuum cleaner, constructed in accordance with the teachings of the present invention.

Reference is now made to FIG. 1 showing a floor care apparatus of the present invention. The apparatus illustrated exemplifies an upright vacuum cleaner 10 comprised generally of a housing 14 that comprises the nozzle assembly 16 and the canister assembly 18. The canister assembly 18 further includes the handle 20 and the hand grip 22 for maneuvering the cleaner during use. The hand grip 22 carries a control switch 24 for turning the vacuum cleaner 10 on and off while electrical power is supplied from a standard electrical wall outlet through a cord and plug assembly 17. The handle 20, among other things, carries a visual indicator 23 of sorts to indicate a bag-full and/or filling condition of a dust bag as will be described below. At the lower portion of the canister assembly 18, rear wheels (not shown) are provided to support the weight of the vacuum cleaner 10. A second set of wheels (not shown) allow the operator to raise and lower the nozzle assembly 16 through selective manipulation of a height adjustment switch 28. To allow for convenient storage of the vacuum cleaner 10, a foot latch 30 functions to lock the canister assembly 18 in an upright position, as shown in FIG.

1. When the foot latch 30 is released, the canister assembly 18 may be pivoted relative to the nozzle assembly 16 as the vacuum cleaner 10 is manipulated to clean the floor.

Also, the canister assembly 18 carries an internal chamber 32 that houses a suction fan motor 33 (i.e. a state of the art fan and motor combination) and a dust bag 34 for removing dirt or dust entrained in the air stream as it passes in an airflow path from the nozzle assembly 16 to the suction fan motor. During use, the suction fan motor 33 creates the suction airflow in a well known manner.

In the nozzle assembly 16, a nozzle and agitator cavity 36 houses an agitator 38. The rotary scrubbing action of the agitator 38 and the negative air pressure created by the suction fan motor 33 cooperate to brush and beat dirt and dust from the nap of the carpet being cleaned and then draw the dirt and dust laden air from the agitator cavity 36 to the dust bag 34. Specifically, the dirt and dust laden air passes serially through a suction inlet and hose (not shown) and/or an integrally molded conduit in the nozzle assembly 16 and/or canister assembly 18 as is known in the art. Next, it is delivered into the chamber 32 and passes through the porous walls of the dust bag 34. The bag 34 serves to trap the suspended dirt, dust and other particles inside while allowing the now clean air to pass freely through the wall thereof. Clean air then flows through the suction fan motor 33, final filtration cartridge 42 and, ultimately, to the environment through the exhaust port 44.

Figure 2:
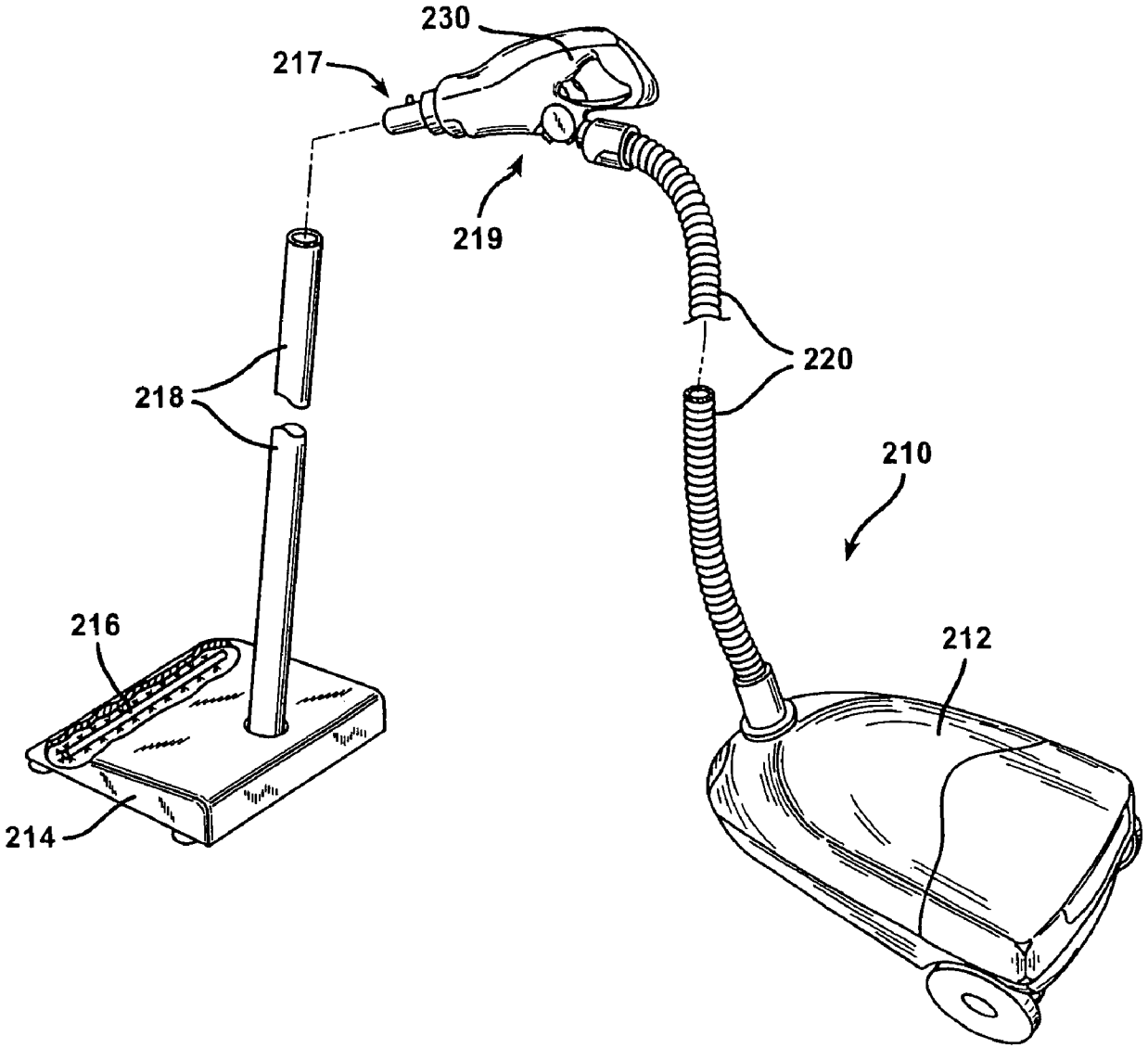
FIG. 2 is a perspective view of a floor care apparatus, in this instance a canister vacuum cleaner, constructed in accordance with the teachings of the present invention.

With reference to FIG. 2, a floor care apparatus of the present invention in this embodiment exemplifies a canister vacuum cleaner 210 comprised generally of a base assembly 212 and a nozzle assembly 214. Although not shown, the base assembly contains a suction fan motor that cooperates with an agitator 216 in the nozzle assembly for sucking up dirt and dust in the manner previously described for the upright cleaner. A wand 218 mechanically and fluidly connects to the nozzle assembly and facilitates the sucking up of dirt and dust. In various embodiments, it comprises a unitary, telescopic or connecting section of pipe. Near the base assembly, a hose 220, flexible for user manipulation, connects thereto and likewise facilitates cleaning. Finally, a handle 230 having ends 217, 219 connects mechanically and fluidly to both the wand 18 and the hose 220 and enables an airflow path between the nozzle assembly and the suction fan motor of the base assembly.

Figure 3:
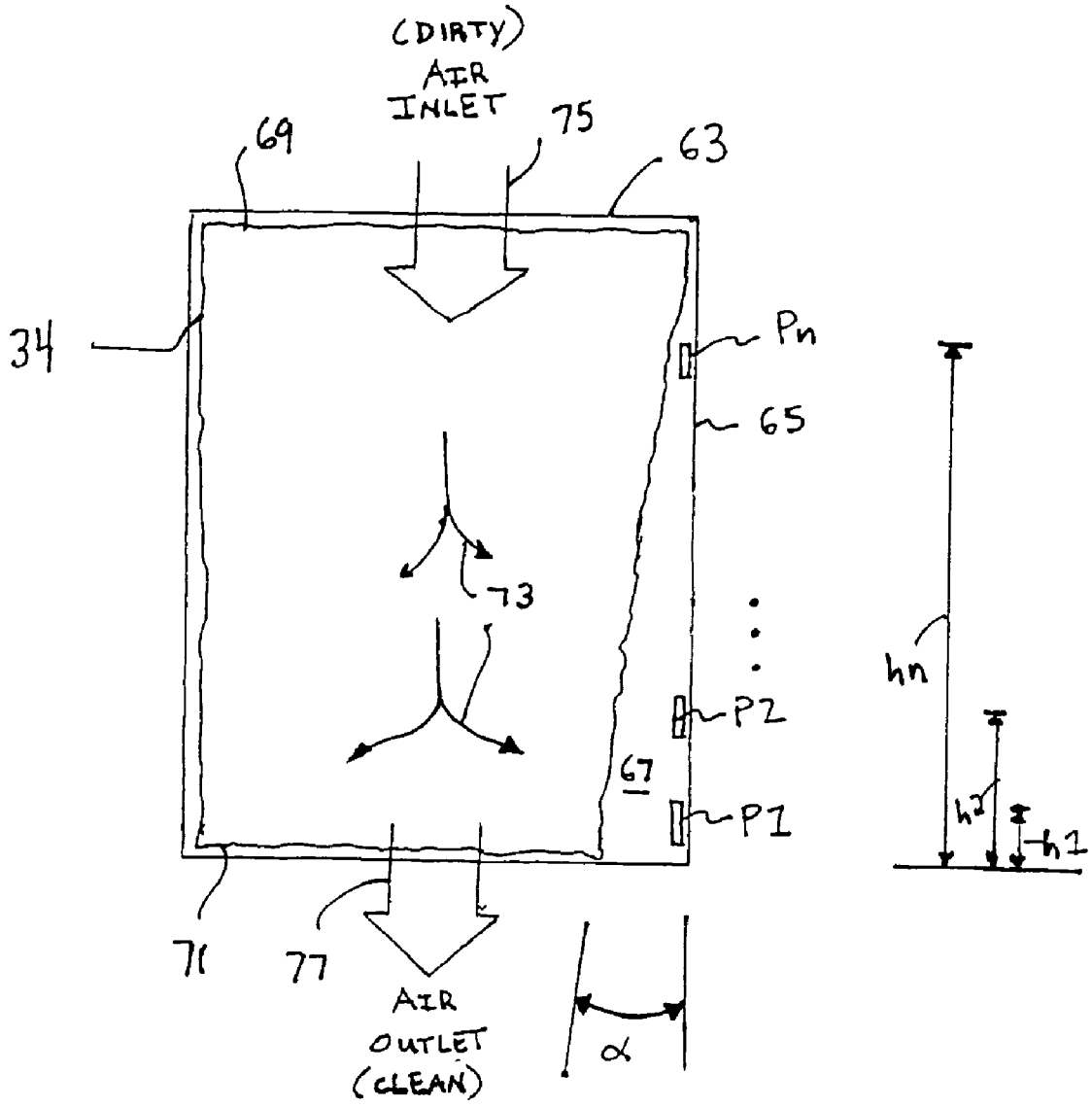
FIG. 3 is a diagrammatic view of a dust bag and housing for indicating a filling condition of the bag.

In either floor care apparatus embodiment, the cleaners have a dust bag within a housing configured to enable the indication to users of a relative fullness and/or filling condition of the dust bag during use. With reference to FIG. 3, the dust bag 34 of the invention is angled $\alpha$ relative to a wall 65 of the housing 63. In this regard, preferred angular orientations range between about 10 to about 80 degrees with more preferred ranges including about 15 to about 45 degrees. As will become apparent hereafter, the best angle is not exact and represents a compromise between having a large enough dust bag to capture voluminous amounts of dust for users and having enough room or space to ascertain the bag filling condition thereof.

In a space 67 of the housing between the dust bag and the wall, where the dust bag is angled relative to the wall, a plurality of pressure sensors P1, P2, . . . Pn reside. Pressure sensors, in one embodiment, may be of a type to sense strain/force of air pressure (differential, absolute and/or combinations). During use, as air flows in the direction of arrows 75, 77 from an air inlet 69 to an air outlet side 71 of the dust bag, dust and other particles become cleaned from the airstream and trapped in the bag as represented by arrows 73. The dust bag then expands in the direction of the pressure sensors in the space 67 and impinges upon a first of the pressure sensors P1 and subsequently upon a second of the pressure sensors P2, and so on until impinging upon the final pressure sensor Pn. In this manner, a filling condition of the dust bag is indicated. Namely, because the angle exists between the bag and wall, pressure sensors become contacted or impinged one at a time such that no two pressure sensors ever become impinged at the same time. As a result, the signals output from the sensors indicate, at any given moment, an impinged or to-be-impinged status. By then aligning the pressure sensors in the space 67, a sort of a relative difference of the signals of the sensors reveals the filling condition of the bag. For instance, at a time when only pressure sensor P1 has been impinged, it can be inferred that the filling status or condition of the dust bag is relatively low, in the vicinity of sensor P1 at a height of about h1. Later, at a time when pressure sensor P2 becomes impinged, the dust bag can be inferred as being filled to a height of about h2. Eventually, the dust bag is inferred as being filled, at a height of about hn, when the final pressure sensor Pn is impinged by the dust bag.

Figure 4:
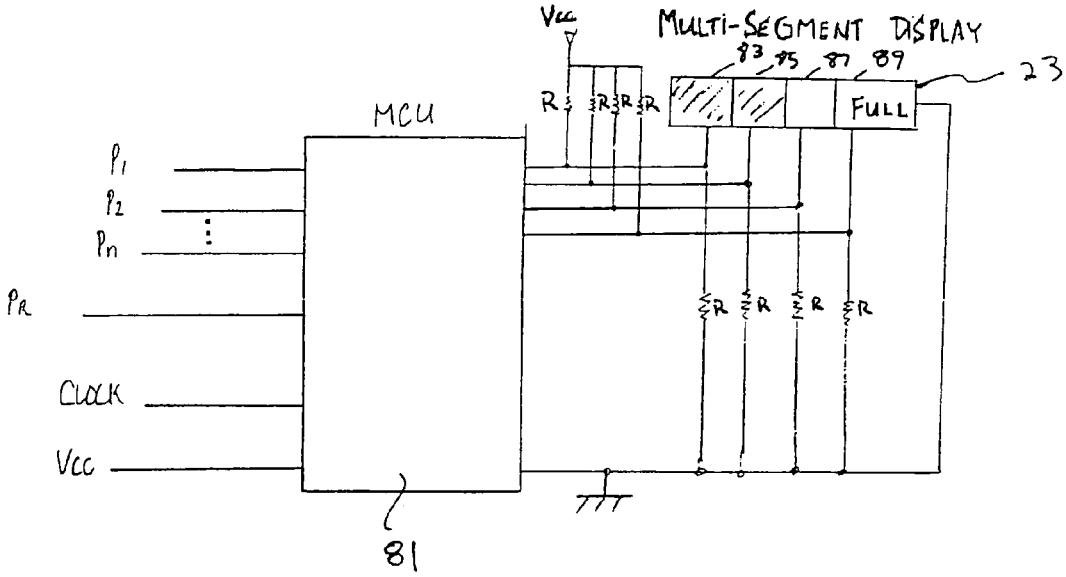
FIG. 4 is a diagrammatic and circuit view of a first embodiment of a processor and visual indicator for showing the relative fullness of the dust bag.
Figure 5:
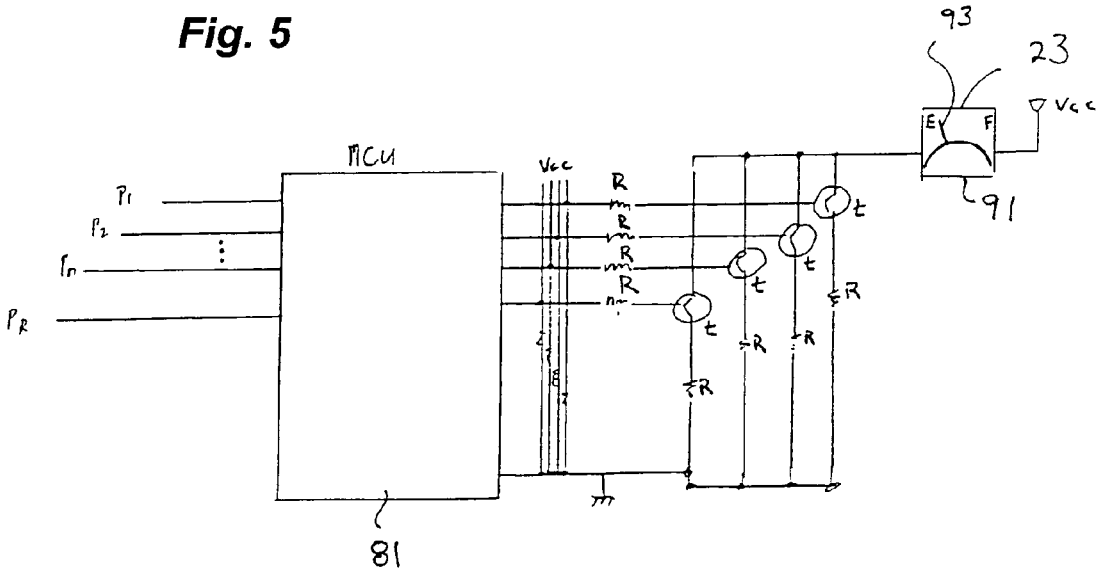
FIG. 5 is a diagrammatic and circuit view of a second embodiment of a processor and visual indicator for showing the relative fullness of the dust bag.

With reference to FIGS. 4 and 5, each of the pressure sensors P1, P2, . . . Pn are connected to a processor 81. Examples of preferred processors include, but are not limited to, microprocessor(s), application specific integrated circuit(s) (ASIC), software or other programming, or the like. Regardless of type, the processor is configured to sort a relative difference between each of the signals of the sensors and appropriately provide signals to a visual indicator to show the relative fullness of the dust bag. In this regard, the processor is configured with varieties of external power supplies (Vcc), clock signals (Clock), resistors (®), transistors (t), etc. to drive a visual indicator 23. In one instance, the visual indicator is a segmented display having segments 83, 85, 87, 89 that sequentially light to show a filling status of the dust bag from empty to full. In another, the visual indicator is a gauge 91 having an analog meter 93 indicating a bag status between empty (E) and full (F), inclusive. Of course, skilled artisans can contemplate other visual indicators and all are embraced herein.

Also, the sorting of relative differences between signals of the pressure sensors may be further enhanced via comparison to a reference pressure Pr stored, for example, as a single or table of values in an attendant memory. In this regard, reference pressures include, but are not limited to, an ambient pressure external to the floor care apparatus or a minimum pressure that must be overcome before providing any visual indications to users. The memory also contemplates resetting functionality that occurs when users replace full dust bags with new, empty ones. Regardless, the more pressure sensors employed in the design, the more data points available to the processor and the more accurate the filling indication to users can be made. Naturally, a trade off exists between providing too many pressure sensors relative to the cost (economic and size) of making a floor care apparatus feasibly. In one embodiment, preferred numbers of sensors include a minimum of three and a maximum of six. Preferred examples of pressure sensor types include, but are not limited to, air pressures sensors (differential or absolute pressure) of the type including the Honeywell brand CPC, CPX or XPC series; Omrom brand D8 series; or ICS brand 1200 series; or force sensors of the type including the Honeywell brand FSL and FSS series; or Flexiforce brand A200 series arranged as a pressure sensing strip/adhesive. Preferred signals of the sensors include, but are not limited to, those providing signals on the order of a few ounces per square inch. Preferred methods of mounting the sensors to the wall include mechanical fasteners and/or adhesives.

In other embodiments, and appreciating the angular relation between the dust bag and housing wall may be achieved in several ways, FIGS. 6-14 are provided to show specific alternate designs of the invention. Also, like reference numerals are included to indicate like structures in other figures.

Figure 6:
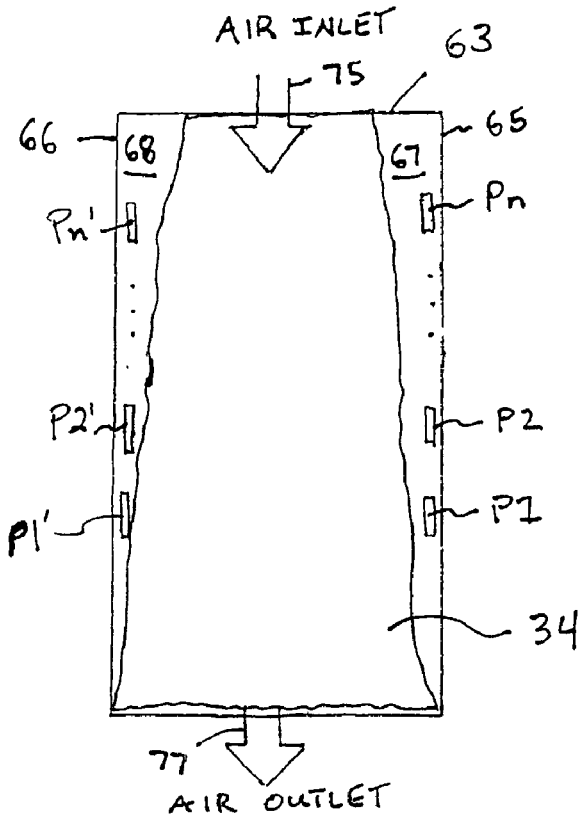
FIG. 6 is a diagrammatic view of an alternate embodiment of a dust bag and housing for indicating a filling condition of the bag.

In FIG. 6, for instance, a dust bag 34 has not only one portion configured to create an angular relation with the housing wall, but two. In this regard, the dust bag 34 is tapered substantially symmetrically along its length from its air inlet to its air outlet side such that spaces 67 and 68 are created between the dust bag and walls 65, 66, respectively. As before, pressure sensors P1, P2, . . . Pn fill the space 67 and are used to create relative signal differences (sorted by processor 81, FIGS. 4 and 5) between one another as the bag fills, expands and sequentially impinges upon the sensors. However, additional sensors P1', P2', . . . Pn' in space 68 can be used, in addition to or in lieu of the sensors in the space 67, to indicate other relative signal differences as the bag fills, expands and sequentially impinges upon the sensors.

Figure 7:
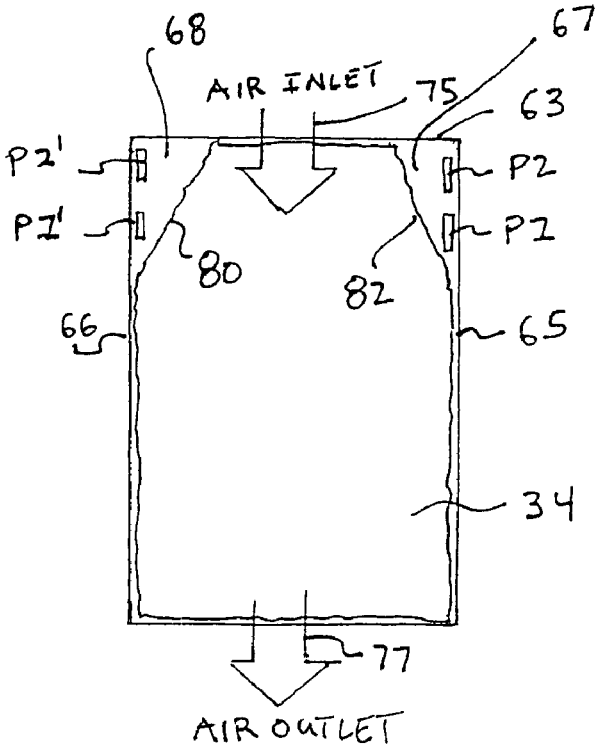
FIG. 7 is a diagrammatic view of another alternate embodiment of a dust bag and housing for indicating a filling condition of the bag.

In FIG. 7, the dust bag 34 includes two portions 80, 82 enabling a the dust bag to have an angular disposition relative to walls 66, 65 of the housing in only select areas. In comparison to other embodiments, the taper of the dust bag occurs only for a portion of the entire length of the dust bag from its air inlet to its air outlet side. Also, this embodiment need only have a single portion (either 80 or 82), to operate and such is further embraced herein. In all other regards, the invention works as previously described.

Figure 8:
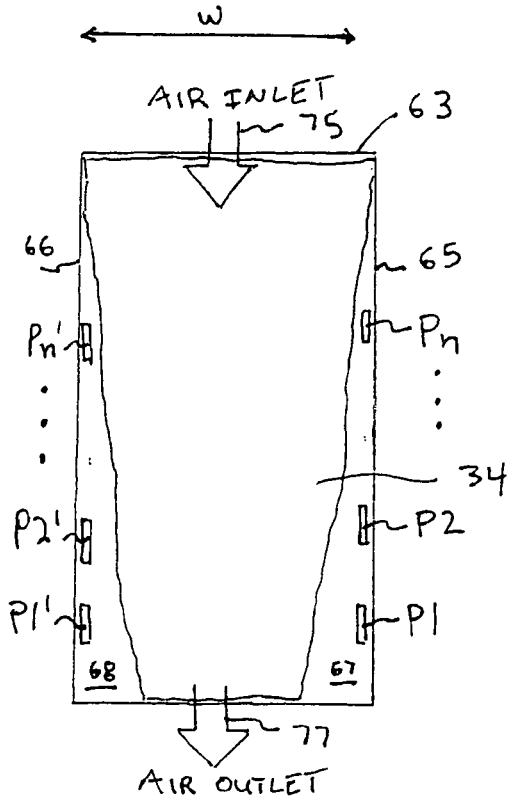
FIG. 8 is a diagrammatic view of still another alternate embodiment of a dust bag and housing for indicating a filling condition of the bag.

In FIG. 8, a dust bag 34 is shown having a reverse taper as compared to the dust bag of FIG. 6. That is, the dust bag of FIG. 8 has a width (parallel to the axis labeled w) wider at its air inlet side as compared to its air outlet side. Conversely, FIG. 6 shows a dust bag with a width narrower at its air inlet side as compared to its air outlet side.

Figure 9:
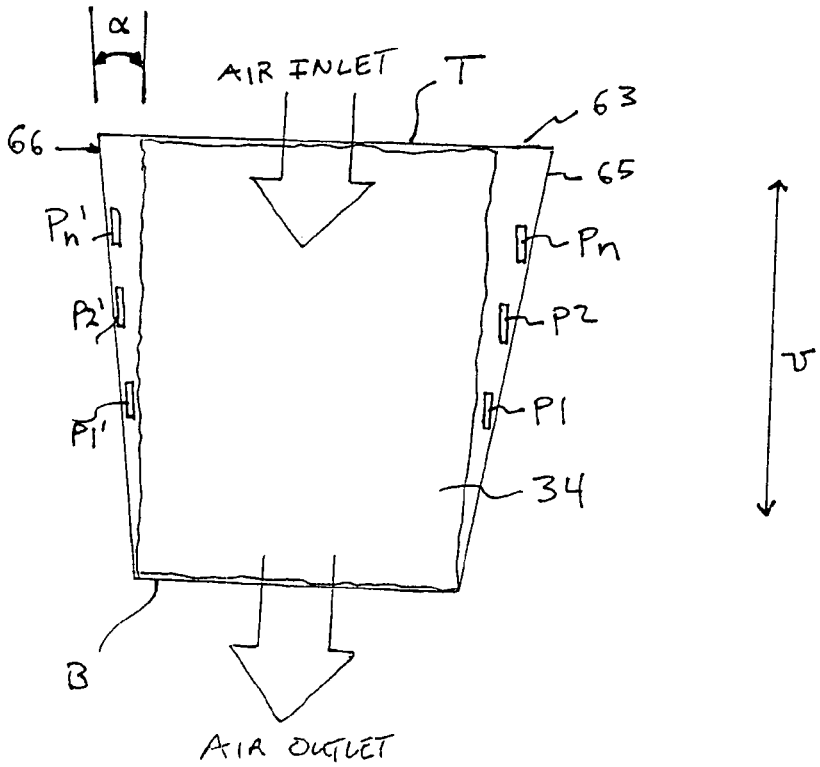
FIG. 9 is a diagrammatic view of yet another alternate embodiment of a dust bag and housing for indicating a filling condition of the bag.

In FIG. 9, angular relationships between a dust bag 34 and walls 65, 65 of a housing 63 are achieved by creating a non-rectangular housing. In this regard, the cross-section of the periphery of the housing 63 typifies a trapezoid while the dust bag cross section is maintained as a rectangle. An angle $\alpha$ is then obtained between the dust bag and wall and the space thereof is filled with pressure sensors that create signals used in indicating relative fullness as previously described. Naturally, other housing shapes are possible. It is also possible that the trapezoid housing shape shown is inverted such that its base B is wider than its top T. As compared to other embodiments, this design is the first to indicate the lack of vertical alignment (parallel to the axis labeled v) between adjacent pressure sensors. In no manner, however, does this implicate the filling of the dust bag, its expansion and sequential impingement upon each of the sensors such that a processor can sort a relative difference between the signals thereof.

Figure 10:
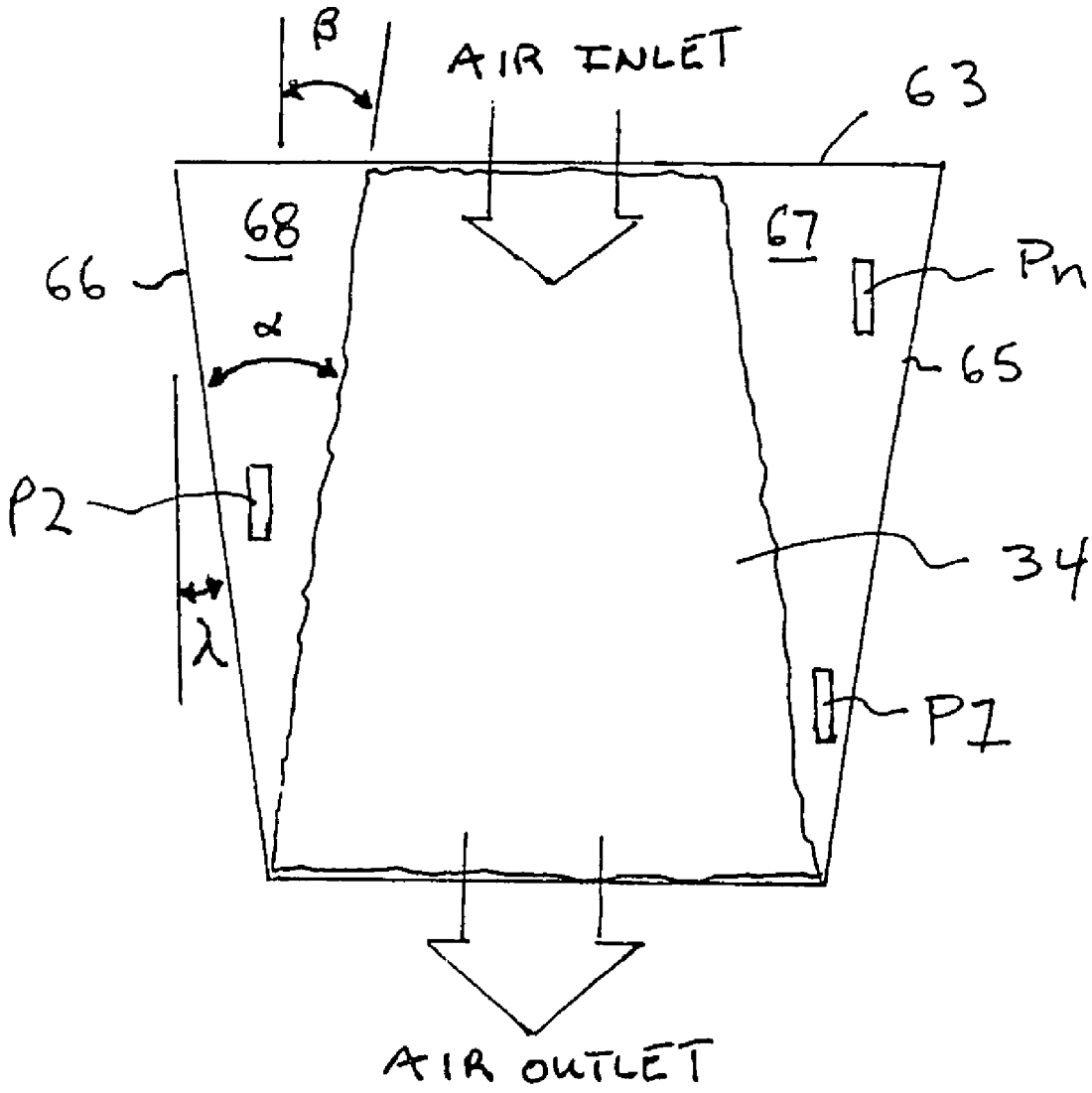
FIG. 10 is a diagrammatic view of still yet another alternate embodiment of a dust bag and housing for indicating a filling condition of the bag.

In still another embodiment, FIG. 10 illustrates many of the previous features in a single design plus those not yet mentioned. Namely, the dust bag 34 includes a taper along its length from its air inlet to air outlet side. In this regard, an angle $\beta$ is created between a vertical axis and the taper of the bag. Also, the walls 65, 66 of the housing 63 are angled relative to vertical which creates still another angle $\lambda$. Together, the design affords an angle $\alpha$ between the walls of the housing and the dust bag, the spaces 67, 68 of which include a plurality of pressure sensors P1, P2, and Pn. However, adjacent pressure sensors in this design appear on opposite sides of the dust bag. As the dust bag fills with dust, the bag expands and impinges first upon pressure sensor P1 on one side of the bag and subsequently upon P2 on an opposite side of the bag and so on until all sensors are impinged. In all other regards, the invention operates as previously described.

Figure 11:
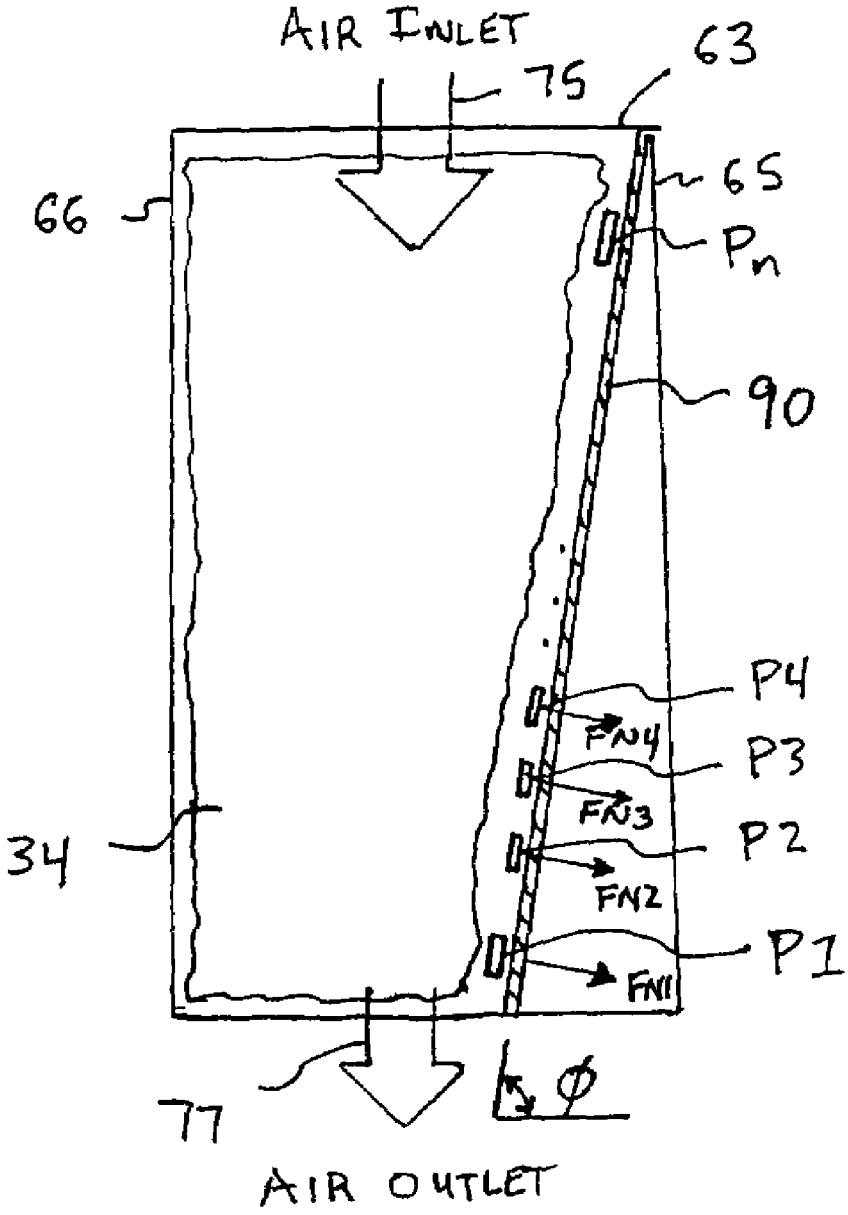
FIGS. 11-14 are diagrammatic views of embodiments of the invention including ribs for pressure sensors, especially sensors detecting force pressure.

Referring to FIG. 11, a housing 63 of the invention potentially further includes a rib 90. In one embodiment, the rib is fairly rigid and formed of, for example, the same materials as the housing, including plastic or metal. In this manner, the rib creates a mounting position for the pressure sensors. For example, along a length of the rib, especially fastened or adhered in place, are pressure sensors P1, P2, P3, P4 . . . Pn of the type previously discussed. In one instance, the pressure sensors are of the type for detecting force and, as the dust bag fills, a normal force FN1, FN2, FN3, etc. is exerted. In turn, by monitoring the progression of forces between adjacent sensors, for example, a filling condition of the bag is readily observed. Regarding the angular disposition of the dust bag relative to a housing wall, it roughly follows that of the angular disposition $\phi$ of the rib relative to the wall. Considerations regarding steepness or shallowness of the rib relative to the wall represents a compromise between having a large enough dust bag to capture voluminous amounts of dust and having enough room or space to ascertain the bag filling condition. Exemplary angles are those previously taught, including being in a range from about 10 to about 80 degrees.

Figure 12:
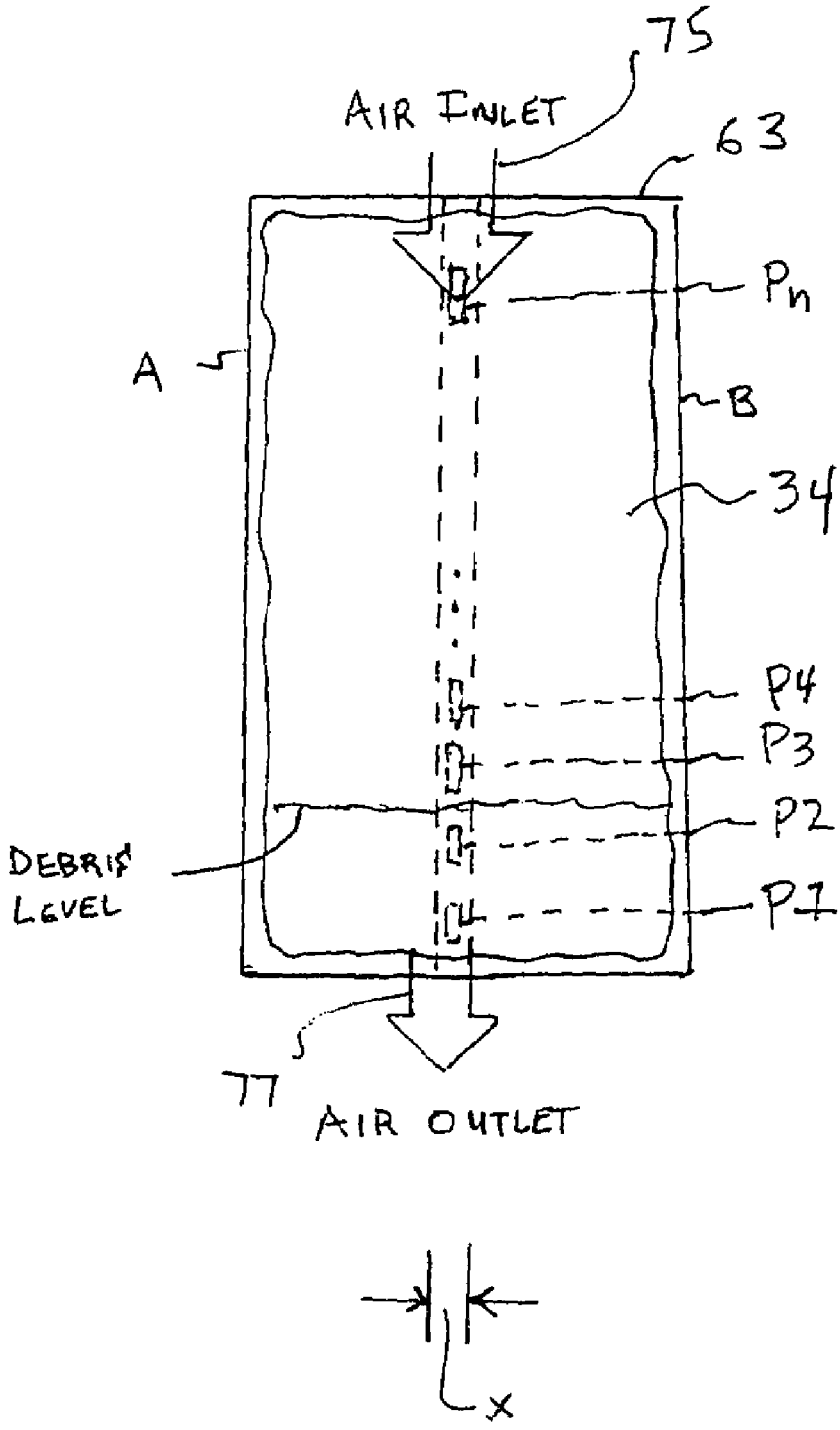

In FIG. 12, the view is that of FIG. 11, except its perspective is from a relative front of the cleaner vice side. In this manner, skilled artisans can view a relative width x of the rib and its relative, central placement between housing walls A and B. A debris level is also indicated to show a scenario in which the bottom two pressure sensors P1 and P2 indicate normal forces FN1, FN2 at a time while the other sensors do not. Thus, processing of the normal forces would indicate a dust bag 34 having a relative fullness at a height greater than P2 but less than P3.

Figure 13:
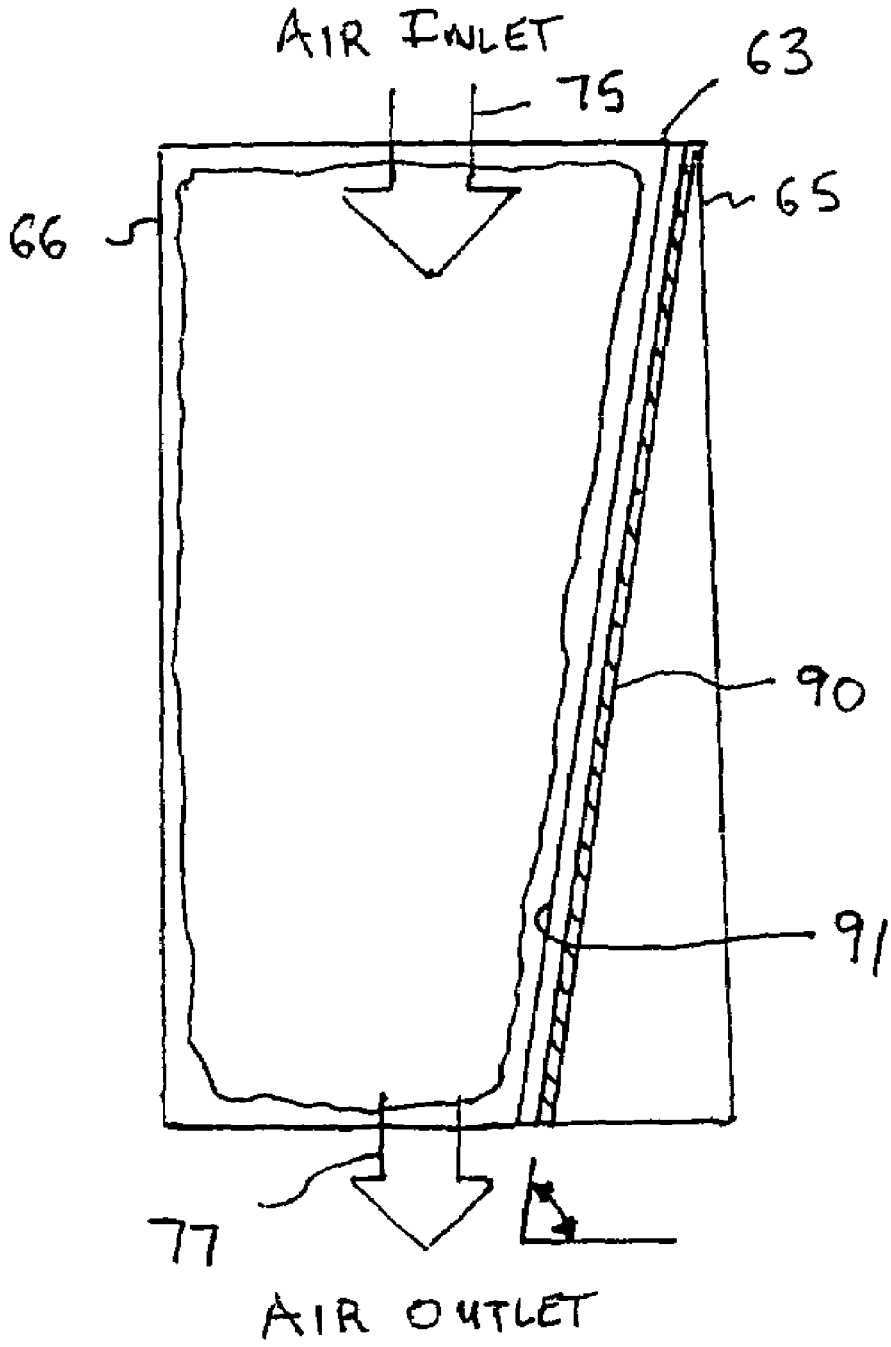

In FIG. 13, the individual discrete pressure sensors P1, P2, P3, etc. on the rib 90 of FIG. 11 are replaced with a single pressure sensing adhesive strip 91 along a substantial length of the rib that can also serve to sense force of debris as it fills the dust bag 34. In all other regards, the invention works as previously described. Alternatively, the single pressure sensing adhesive strip 91 could be multiple such adhesive strips.

Figure 14:
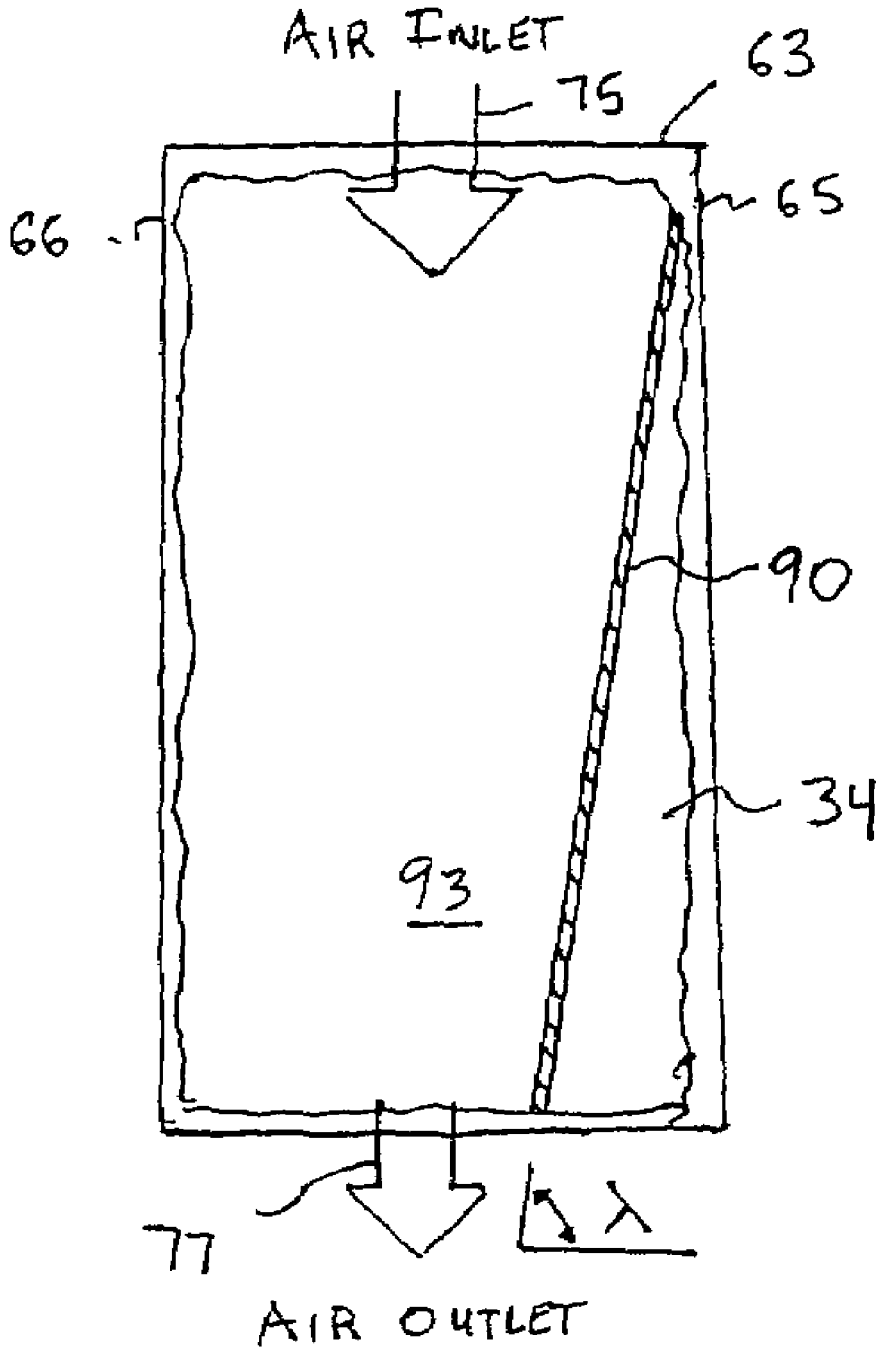

In still another embodiment, FIG. 14 teaches the inclusion of the rib 90 and attendant pressure sensors, either discrete sensors or strips (not shown), within an interior 93 of the dust bag 34. In this manner, replacement dust bags are made with internal pressure sensors or specialized bags are made to accommodate a housing 63 including a rib. Regarding the angular disposition of the bag relative to the housing wall, it then occurs as a function of the angle $\lambda$ of the rib relative to the wall.

In still other embodiments, various features of the many figures can be combined with one another to achieve an optimum design.

The foregoing was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

The invention claimed is:

1. A floor care apparatus, comprising:

a housing having a wall;

a dust bag within the housing and angled relative to the wall; and a plurality of pressure sensors between the wall and the dust bag where the dust bag is angled relative to the wall so that, during use as the dust bag fills, the dust bag first contacts one of the pressure sensors and then sequentially contacts at least one additional pressure sensor thereby indicating a filling of the dust bag.

2. The floor care apparatus of claim 1, further including a processor connected to each of the plurality of pressure sensors to sort a relative difference between signals from the one and the another pressure sensors during the filling.

3. The floor care apparatus of claim 1, further including a visual indicator showing a relative fullness of the dust bag during use.

4. The floor care apparatus of claim 3, wherein the visual indicator includes a segmented display or analog meter.

5. The floor care apparatus of claim 1, wherein the dust bag and the wall are angled relative to one another in a range from about 15 to about 45 degrees.

6. The floor care apparatus of claim 1, wherein the dust bag is tapered from an air inlet to an air outlet side.

7. The floor care apparatus of claim 1, wherein the dust bag includes first and second portions angled relative to the wall.

8. The floor care apparatus of claim 1, wherein the plurality of pressure sensors are vertically aligned in a space between the wall and the dust bag where the dust bag is angled relative to the wall.

9. The floor care apparatus of claim 1, wherein the housing further includes a rib, the plurality of pressure sensors being fashioned on the rib.

10. The floor care apparatus of claim 9, wherein the rib is in an interior of the dust bag.

11. The floor care apparatus of claim 1, wherein the pressure sensor detects force pressure.

12. A floor care apparatus, comprising:

a housing having an internal chamber including a wall;

a dust bag within the internal chamber and angled relative to the wall;

a plurality of pressure sensors aligned in a space between the wall and the dust bag where the dust bag is angled relative to the wall so that, during use as the dust bag fills, the dust bag contacts a first of the pressure sensors and subsequently contacts at least a second of the pressure sensors thereby indicating a filling of the dust bag with dust;

a processor connected to the pressure sensors to sort a relative difference between one of 1) signals from each of the first and second pressure sensors during the filling, and 2) signals from either the first and second pressure sensors during the filling and a reference pressure; and a visual indicator connected to the processor to indicate a relative fullness of the dust bag during use according to the relative difference sorted by the processor.

13. The floor care apparatus of claim 12, wherein the dust bag is tapered from an air inlet to an air outlet side.

14. The floor care apparatus of claim 12, wherein the dust bag includes first and second portions angled relative to the wall and at least one of the plurality of pressure sensors is disposed between the wall and each of the first and second portions.

15. The floor care apparatus of claim 12, further including a rib in the internal chamber of the housing.

16. The floor care apparatus of claim 12, wherein the pressure sensors sense one of air pressure and force pressure.

* * * * *